US011072446B2

(12) United States Patent
Werk et al.

(10) Patent No.: US 11,072,446 B2
(45) Date of Patent: Jul. 27, 2021

(54) PREPARING A DOUBLE CHAMBER CONTAINER

(71) Applicant: Hoffmann-La Roche Inc., Little Falls, NJ (US)

(72) Inventors: Tobias Werk, Riehen (CH); Jörg Lümkemann, Lörrach (DE); Hanns-Christian Mahler, Lörrach (DE)

(73) Assignee: HOFFMAN-LA ROCHE INC., Little Falls, NJ (US)

( * ) Notice: Subject to any disclaimer, the term of this patent is extended or adjusted under 35 U.S.C. 154(b) by 480 days.

(21) Appl. No.: 15/531,898

(22) PCT Filed: Dec. 4, 2015

(86) PCT No.: PCT/EP2015/078606
§ 371 (c)(1),
(2) Date: May 31, 2017

(87) PCT Pub. No.: WO2016/087626
PCT Pub. Date: Jun. 9, 2016

(65) Prior Publication Data

US 2017/0267383 A1 Sep. 21, 2017

(30) Foreign Application Priority Data

Dec. 5, 2014 (EP) ..... 14196466

(51) Int. Cl.
*B65B 7/28* (2006.01)
*B65B 3/00* (2006.01)

(52) U.S. Cl.
CPC ..... *B65B 7/2821* (2013.01); *B65B 3/003* (2013.01); *B65B 2230/02* (2013.01)

(58) Field of Classification Search
CPC .... B65B 2230/02; B65B 3/003; B65B 7/2821
(Continued)

(56) References Cited

U.S. PATENT DOCUMENTS 4,774,772 A * 10/1988 Vetter ..... A61M 5/008 211/69
5,184,450 A * 2/1993 Galy ..... A61M 5/31596 53/127

(Continued)

FOREIGN PATENT DOCUMENTS

EP 0 875 453 11/1998
EP 2 676 689 12/2013

(Continued)

OTHER PUBLICATIONS

International Search Report and Written Opinion, issued in PCT/EP2015/078606, dated Feb. 2, 2016.

*Primary Examiner* — Robert F Long
*Assistant Examiner* — Xavier A Madison
(74) *Attorney, Agent, or Firm* — Medler Ferro Woodhouse & Mills PLLC

(57) ABSTRACT

A method of preparing a double chamber container is disclosed that includes filling a substance into the container, freeze-drying the substance therein, inserting a middle plunger in the container to form distal and proximal chambers, wherein the middle plunger seals the distal chamber from the proximal chamber and the freeze-dried substance is inside the distal chamber. The method includes filling a reconstitution medium in the proximal chamber, and sealing distal and proximal openings of the container. The method includes providing a holder having a seat and arranging the container in the seat in an upright position wherein a distal end side of the container extends downwardly and a proximal end side of the container extends upwardly. The container is arranged in the seat while the substance is filled, the substance is freeze-dried, the middle plunger is inserted, the reconstitution medium is filled, and the proximal opening is sealed.

15 Claims, 4 Drawing Sheets

(58) Field of Classification Search
USPC ..... 53/440
See application file for complete search history.

(56) References Cited

U.S. PATENT DOCUMENTS

| | | | | |
|---|---|---|---|---|
| 5,185,985 | A * | 2/1993 | Vetter | A61M 5/008 141/372 |
| 5,334,162 | A * | 8/1994 | Harris | A61J 1/062 604/232 |
| 5,788,670 | A * | 8/1998 | Reinhard | A61M 5/3129 604/191 |
| 2006/0054523 | A1* | 3/2006 | Porret | A61L 2/206 206/439 |
| 2007/0129673 | A1* | 6/2007 | Bassarab | A61M 5/2448 604/85 |
| 2011/0094188 | A1 | 4/2011 | Böttger et al. | |
| 2011/0094189 | A1 | 4/2011 | Böttger et al. | |
| 2011/0154681 | A1 | 6/2011 | Kuu et al. | |
| 2012/0248057 | A1 | 10/2012 | Bogle et al. | |
| 2013/0197467 | A1* | 8/2013 | Schuetz | A61J 1/2093 604/416 |
| 2015/0041498 | A1* | 2/2015 | Kakiuchi | A61M 5/284 604/191 |

FOREIGN PATENT DOCUMENTS

| | | |
|---|---|---|
| JP | H-0751365 | 2/1995 |
| JP | H-08164204 | 6/1996 |
| JP | 4536825 | 9/2010 |
| RU | 2512298 C2 | 4/2014 |

* cited by examiner

PREPARING A DOUBLE CHAMBER CONTAINER

TECHNICAL FIELD

The present invention relates to a method of preparing a double chamber container according to the preamble of independent claim 1 and more particularly to a facility for automatically performing such a method and a double chamber container being prepared by such a method.

Methods of preparing a double chamber container with a distal end side, a proximal end side opposite to the distal end side, an interior between the distal end side and the proximal end side, a distal opening arranged in the distal end side for providing a medium out of the double chamber container and a proximal opening in the proximal end side, which comprise the steps of filling a substance in the interior of the double chamber container; freeze-drying the substance inside the double chamber container; inserting a middle plunger in the interior of the double chamber container such that a distal chamber and a proximal chamber are formed, wherein the middle plunger seals the distal chamber from the proximal chamber and wherein the freeze-dried substance is inside the distal chamber; filling a reconstitution medium in the proximal chamber of the double chamber container; and sealing the distal opening of the double chamber container and the proximal opening of the double chamber container, can be used for efficiently providing lyophilized pharmaceuticals in double chamber containers.

BACKGROUND ART

Many pharmaceutical products are applied to patients in liquid form wherein injecting the product often is most efficient and preferred. However, many pharmaceutical products and particularly biopharmaceutical products are highly unstable in liquid form. Therefore, often cumbersome measures are taken in order to keep liquid pharmaceuticals stable.

A known approach to address this problem is to provide pharmaceutical products in a freeze-dried or lyophilized form in which it is essentially more stable and robust compared to its liquid form. The lyophilized pharmaceutical products are then reconstituted or solved in a diluent or liquid, e.g. before being injected.

Thereby, lyophilized pharmaceutical products can be packaged in double chamber containers wherein one chamber houses the lyophilized pharmaceutical product and the other a suitable diluent. The lyophilized pharmaceutical products can then comparably simply be processed such as transported, stocked, sold and the like. Shortly before applying the pharmaceutical product, the diluent is provided to the lyophilized product such that it is solved and in liquid form again.

In particular, for injecting pharmaceutical products dual chamber syringes are known wherein, when being applied, pushing an activation rod fulfils two functions. On one hand, the activation rod is pushed far enough for bringing the diluent and product together and on the other hand it is completely pushed in order to provide the liquidized or solved product out of the needle of the syringe.

For example, EP 1 038 543 B1 describes a double chamber syringe in which a cylindrical syringe body is separated in two chambers by a middle plunger. The open end of the syringe body is closed by a plunger rod. In the distal chamber of the two chambers a lyophilized product is placed and in the proximal chamber a diluent. In the cylindrical wall of the syringe body a bulge is arranged as bypass wherein in the initial state of the syringe the bypass is located adjacent to or in the side wall of the distal chamber. In application of the syringe, when pressing the plunger rod, the pressure inside the syringe body increases such that the middle plunger moves in a distal direction until the bypass is open. When further pushing the plunger rod the diluent passes from the proximal chamber to the distal chamber via the bypass. There, the diluent solves the product which is then ready for being provided or injected through the needle.

Even though such double chamber syringes allow for a comfortable and efficient application of the pharmaceutical product the preparation of such syringes is comparably cumbersome and often costly, particularly on an industrial level. In known preparation methods, typically a single syringe body is aligned with its distal end having an orifice up and the proximal end having the open end down. While being positioned like this, the interior of the syringe body is washed, siliconized and sterilized. Then the middle plunger is pushed bottom-up into the interior of the syringe body through the open end such that an upper distal and a lower proximal chamber is formed. The liquid pharmaceutical is filled from top into the distal chamber via the orifice. Then the liquid pharmaceutical is freeze-dried wherein the diluent escapes through the orifice from the syringe body. After freeze-drying the distal end or orifice is sealed with a cap and the syringe is turned around such that the distal chamber is below the proximal chamber. Then the diluent is filled top down into the proximal chamber of the syringe and a end plunger is pushed top-down into the proximal chamber. After that, the syringe is turned around again such that the proximal chamber is below the distal chamber. The proximal end is then provided with a finger rest cap into which a rod is pushed up to the end plunger.

In the light of such known preparation of double chamber syringes, there is a need for a method allowing efficiently preparing a double chamber container such as a syringe comprising a lyophilisate in one chamber and a reconstitution medium such as a diluent in the other chamber.

DISCLOSURE OF THE INVENTION

According to the invention this need is settled by a method as it is defined by the features of independent claim 1, by a facility for automatically performing such a method and by a double chamber container as it is defined by the features of independent claim 14. Preferred embodiments are subject of the dependent claims.

In particular, the invention deals with a method of preparing a double chamber container. The double chamber container has a distal end side, a proximal end side opposite to the distal end side, an interior between the distal end side and the proximal end side, a distal opening arranged in the distal end side for providing a medium out of the double chamber container and a proximal opening in the proximal end side. The method comprises the steps of: filling a substance in the interior of the double chamber container; freeze-drying the substance inside the double chamber container; inserting a middle plunger in the interior of the double chamber container such that a distal chamber and a proximal chamber are formed, wherein the middle plunger seals the distal chamber from the proximal chamber and wherein the freeze-dried substance is inside the distal chamber; filling a reconstitution medium in the proximal chamber of the double chamber container; and sealing the proximal opening of the double chamber container. The method further comprises providing a holder having a seat designed to receive the double chamber container in an upright position and arranging the double chamber container in the seat of the holder such that, in the upright position, the distal end side of the double chamber container extends downwardly and the proximal end side of the double chamber container extends upwardly. The double chamber container is arranged in the seat of the holder while the substance is filled in the interior of the double chamber container, while the substance is freeze-dried inside the double chamber container, while the middle plunger is inserted in the interior of the double chamber container, while the reconstitution medium is filled in the proximal chamber of the double chamber container, and while the proximal opening of the double chamber container is sealed. Advantageously, the method is performed in a sterile or inert environment.

The double chamber container can have an elongated general shape. Its body portion or barrel can have an essentially cylindrical shape or more specific a circular cylindrical shape. The double chamber container can further have a finger flange being integral with its body portion. It can be made of any suitable sterilizable material such as glass or the like.

The double chamber container can be suitable for providing a substance intended for lyophilisation. For example, it can be a vial or a syringe. In particular, it can be a double chamber syringe which, in a finally prepared status, has a first chamber containing a loyphilisate or freeze-dried substance or product and a second chamber containing a reconstitution medium such as a liquid diluent.

The device according to the invention can particularly be beneficial in processes of preparing chemical or pharmaceutical substances in a ready-to-use form. In particular, it can increase efficiency of packaging the substances in containers, e.g. in a preparation process including freeze-drying. The terms "pharmaceutical substance", "pharmaceutical product", "pharmaceutical" are synonymously used herein. Also, the terms "freeze-drying" and "lyophilizing" are used synonymously herein.

The distal opening can also be referred to as orifice. It can comprise a needle fixedly mounted to the double chamber container, a needle connector such as a Luer lock connector or Luer taper, typically a male part thereof, or a cartridge. The term Luer lock or Luer taper in this context relates to a wide spread standardized system of small-scale fluid fittings used for making leak-free connections between a male-taper fitting and its mating female part on medical and laboratory instruments or devices. The distal opening can also be covered by a shield protecting the needle or needle connector and sealing the interior of the double chamber container.

The proximal opening can extend over the complete profile of the double chamber container such that it is an open end of the double chamber container. It can be designed to receive an activation rod. It can also be sealed by a cover.

The term "reconstitution medium" as used in context of the invention can relate to any medium being capable of reconstituting the freeze-dried substance. For example it can relate to a liquid diluent solving the freeze-dried substance when being mixed.

The plungers such as the middle plunger or end plunger can also be referred to as stopper. They can be made of an elastic material such as rubber or an elastic plastic material such as butyl.

The term "extend upwardly" as used in connection with the distal end side of the double chamber container refers to the distal end forming a top side of the double chamber container or of its body portion. Similarly, the term "extend downwardly" as used in connection with the proximal end side of the double chamber container refers to the proximal end forms a bottom side of the double chamber container or of its body portion. Thereby, the double chamber container can particularly be essentially vertically aligned.

By using the holder, the double chamber container is aligned in the same upright or distal end down position while being processed in the method according to the invention. In the upright position the distal chamber lies below the proximal chamber. Freeze-drying or lyophilizing the substance in the distal end down position of the double chamber container allows for filling the distal chamber with the substance to a comparably high extent. This is particularly possible since in the distal end down position the proximal chamber can be used as head space for preventing contamination and spillage such that no extra head space has to be provided as in known systems and methods.

The terms "freeze-drying" and "lyophilizing" are used synonymously herein.

When being automatically applied, e.g. in a suitable manufacturing preparation facility, the double chamber container can efficiently be handled together with the holder. In particular, the holder can be embodied an accordance with industrial standards such that standardized machines and robots can be used for processing the double chamber container.

Further, the method according the invention allows for preventing turning the double chamber container around, i.e. from a distal side down to a distal side up position and vice versa. Thus, these comparably complex movements are not necessary such that the double chamber container can efficiently and rapidly be prepared.

Still further, since the proximal side is up and the distal side is down throughout all steps implemented by the method, the comparably large proximal opening is always easily accessible such that the substance, the reconstitution medium and the plungers can efficiently and rapidly be provided to the double chamber container.

Beyond others for the reasons above the method according to the invention allows for efficiently preparing the double chamber container comprising the freeze-dried substance or lyophilisate in the distal chamber and the reconstitution medium in the proximal chamber.

Preferably, the substance is filled in the interior of the double chamber container through the proximal opening of the double chamber container, gas is exiting the double chamber container through its proximal opening while the substance is freeze-dried inside the double chamber container, the middle plunger is inserted in the interior of the double chamber container through the proximal opening of the double chamber container and the reconstitution medium is filled in the proximal chamber of the double chamber container through the proximal opening of the double chamber container.

The term "gas" in this context can relate to any gaseous medium produced during lyophilisation. In particular, it can relate to gaseous water sublimed during freeze-drying the substance.

In such an embodiment the method can be performed in the following order: (1) sealing the distal opening of the double chamber container; (2) filling the substance in the interior of the double chamber container; (3) freeze-drying the substance inside the double chamber container; (4) inserting the middle plunger in the interior of the double chamber container; (5) filling the reconstitution medium in the proximal chamber of the double chamber container; and (6) sealing the proximal opening of the double chamber container. With such a method the double chamber container can be processed in a single position. In particular, turning the double chamber container upside down or flipping the double chamber container can be prevented. This allows for processing the double chamber container in a comparably efficient manner. If the method is performed in a double chamber container preparation facility, step (1) can be performed before the double chamber container is provided to the facility. For example, the distal opening of the double chamber container can be sealed by the manufacturer of the double chamber container and it can delivered with a sealed opening to the facility.

Preferably, the proximal opening of the double chamber container is sealed by inserting an end plunger in the proximal opening of the double chamber container. Such a sealing of the proximal opening allows to use the same or similar means as used for placing the middle plunger. Furthermore, for applying or providing the substance out of the double chamber container when being used, the end plunger can be pressed further into the interior of the double chamber container by an activation rod or the like. Thus, it can also be part of a plunger rod or activation plunger rod.

Preferably, the method comprises a step of optically inspecting the freeze-dried substance as well as optionally the double chamber container and/or optionally the reconstitution medium after sealing the distal opening of the double chamber container and the proximal opening of the double chamber container while the double chamber container is arranged in the seat of the holder. Since the method according to the invention allows for freeze-drying the substance in the double chamber container being arranged distal end down, the freeze-dried substance or cake can be precisely located at the distal end side of the double chamber container. This allows for a precise and efficient inspection of the cake such that a high quality of the freeze-dried product can be assured. Also, in cases where the double chamber container comprises a bypass between the two chambers the cake can be built below the bypass such that the bypass does not affect the inspection when being performed optically.

Preferably, the double chamber container has a side wall connecting the distal end side and the proximal end side and, while freeze-drying the substance inside the double chamber container, heat is conductively transferred through the side wall of the double chamber container. The double chamber container can have an essentially cylindrical shape and particularly the shape of a circular cylinder having a radius and a height. Thereby, the distal and proximal end sides can correspond to the base and top areas at the longitudinal ends of the cylinder. The side wall can be the lateral area along the axis of the cylinder.

Thereby, the heat preferably is conductively transferred through a section of the side wall of the double chamber container which is adjacent to the substance being arranged in the interior of the double chamber container. The mentioned section of the side wall of the double chamber container can particularly comprise all or an essential portion of the side wall of the distal chamber in which the substance is arranged. The conductive heat transfer can comprise heat transfer via gas conduction, contact conduction or a combination thereof. Like this, a direct and efficient heat transfer from and to the substance is possible. In particular, by conductively providing the heat to the substance a comparably homogeneous heat transfer and lyophilisation can be allowed. Thus, the quality of the cake or freeze-dried substance or lyophilisate can be enhanced.

Further, while freeze-drying the substance inside the double chamber container, the section of the double chamber container which is adjacent to the substance being arranged in the interior of the double chamber container preferably is shielded with respect to heat irradiation. Such shield allows for preventing or minimizing the substance being heated by irradiation during freeze-drying but, e.g. mainly by conductive heat transfer. Thus, it can be prevented that the substance is, at least partially, inappropriately heated. This can further increase homogeneity and quality of the lyophilisate or freeze-dried substance or cake.

Preferably, the double chamber container is arranged in a receptacle of a freeze-drying block such that the receptacle of the freeze-drying block encases the distal end side of the double chamber container. The receptacle can be embodied as blind or through hole having an inner shape corresponding to the respective outer surface of the double chamber container. Such freeze-drying block allows for providing heat through the side wall of the double chamber container as described hereinbefore and to shield the double chamber container as described hereinbefore in one. It can be made of a material having a comparably high heat transfer coefficient such as aluminium.

Preferably, the holder is positioned on an alignment device having an adjustment opening such that the double chamber container extends through the adjustment opening of the alignment device while the substance is filled in the interior of the double chamber container. Such alignment device allows for precisely aligning the double chamber container which can be beneficial during filling or when inserting a plunger into the double chamber container.

Thereby, the alignment device preferably comprises two plates each having a through bore, wherein the through bores of the two plates form the adjustment opening of the alignment device and wherein the two plates are laterally movable in relation to each other. The term "laterally movable" in this context can relate to a movement of the plates in a direction along their top and/or bottom surfaces. By laterally moving the plates to each other, the double chamber container can efficiently and precisely be aligned. The alignment device can also comprise more than two plates, particularly three plates with corresponding through bores, which allows for an even more precise alignment of the double chamber container. Thereby, the middle of the three plates can be actively movable in a lateral direction regarding the other two plates.

Further, the distal end side of the double chamber container preferably is arranged in a recess of a centering plate when the double chamber container extends through the adjustment opening of the alignment device. Such a centering plate allows for further precisely aligning the double chamber container during filling. Also, it allows for receiving forces provided to the double chamber container in a longitudinal direction. For example, when the proximal opening is closed by pressing a plunger in the double chamber container via its proximal opening, the plunger pressing force can be received by the centering plate being located at an end of the double chamber container opposite to the proximal opening.

Preferably, the holder has a plurality of seats comprising the seat and at least one identical additional seat, wherein a plurality of double chamber containers comprising the double chamber container and at least one identical additional double chamber container is arranged in the plurality of seats of the holder. Such multiple double chamber container holders can be termed as trays. Thereby, the method preferably comprises the steps of: filling the substance in each of the plurality of double chamber containers while being arranged in the plurality of seats of the holder; freeze-drying the substance inside the plurality of double chamber containers while being arranged in the plurality of seats of the holder; inserting a middle plunger in the interior of each of the plurality of double chamber containers while being arranged in the plurality of seats of the holder; filling the reconstitution medium in the proximal chamber of each of the plurality of double chamber containers while being arranged in the plurality of seats of the holder; and sealing the proximal opening of each of the plurality of double chamber containers while being arranged in the plurality of seats of the holder.

The holder having the plurality of seats can particularly be a nest, e.g. being equipped with about 50 to about 250 identical seats, with about 70 to about 200 identical seats, with about 100 identical seats or with about 166 identical seats. The holder can particularly be designed in accordance with an accepted standard or norm such as ISO/WD 11040-7 of the International Organization for Standardization (ISO). Such a multiple processing of double chamber containers in the holder allows for increasing the efficiency and productivity of the method which can be particularly beneficial for preparing double chamber containers on an industrial level.

When using the freeze-drying block together with the multi seat holder, the freeze-drying block preferably has a plurality of receptacles comprising the receptacle and at least one identical additional receptacle, wherein the plurality of double chamber containers is arranged in the plurality of receptacles of the freeze-drying block when freeze-drying the substance inside the plurality of double chamber containers. Like this, the effects and benefits mentioned above in connection with the freeze-drying block can be applied on the multiple double chamber containers at once.

Similarly, when using the alignment device together with the multi seat holder, the alignment device preferably has a plurality of adjustment openings comprising the adjustment opening and at least one identical additional adjustment opening, wherein the plurality of double chamber containers extends through the plurality of adjustment openings of the alignment device while the substance is filled in the interiors of the plurality of double chamber containers. Like this, the effects and benefits mentioned above in connection with the alignment device can be applied on the multiple double chamber containers at once.

Further, when using the multi seat holder, the middle plunger preferably is arranged together with at least one identical additional middle plunger in respective seats of a plunger tray having a spacer, wherein the plunger tray is arranged with its spacer on the holder such that the middle plunger and the at least one additional middle plunger are adjacent to the proximal openings of the double chamber container and the at least one additional double chamber container, and the middle plunger and the at least one additional middle plunger are inserted through the proximal openings of the plurality of double chamber containers after freeze-drying the substance inside the plurality of double chamber containers. Thus, using such a plunger tray allows for efficiently separating the interior of each double chamber container into the two chambers.

A further aspect of the invention relates to a facility for automatically performing a method according to the invention as described above. The facility comprises a substance dosing feeder for filling a substance in an interior of the double chamber container, a freeze-dryer for freeze-drying the substance inside the double chamber container, a plunger filling arrangement for moving a middle and/or end plunger in the interior of the double chamber container, a medium dosing feeder for filling a reconstitution medium in a proximal chamber of the double chamber container and a transporter for forwarding the double chamber container arranged in a seat of a holder to the substance dosing feeder, to the freeze-dryer, the plunger filling arrangement and the medium dosing feeder. Such a facility allows for efficiently and automatically implementing the method together with its effects and benefits particularly on an industrial level.

Another further aspect of the invention relates to a double chamber container having a non-planar distal end side, a proximal end side opposite to the distal end side, an interior between the distal end side and the proximal end side, a distal opening arranged in the distal end side for providing a medium out of the double chamber container and a proximal opening in the proximal end side, wherein the double chamber container is prepared by a method according to the invention as described above. Such a double chamber container which particularly can be a syringe or embodied as described hereinabove allows for being efficiently manufactured or prepared.

Preferably, the freeze-dried substance inside the distal chamber of the interior of the double chamber container has a shape with a front side adjacent and corresponding to the non-planar distal end side of the double chamber container. Further, the double chamber container preferably comprises a finger flange portion integral with the proximal end side which allows for a convenient application particularly when the double chamber container is a syringe. The main body can be made as one piece together with the finger flange, e.g. of glass. Thereby, the distal opening preferably comprises a needle or a needle connector.

These and other aspects of the invention will be apparent from and elucidated with reference to the embodiments described hereinafter.

BRIEF DESCRIPTION OF THE DRAWINGS

The method, facility and double chamber container according to the invention are described in more detail hereinbelow by way of exemplary embodiments and with reference to the attached drawings, in which.

DESCRIPTION OF EMBODIMENTS

In the following description certain terms are used for reasons of convenience and are not intended to limit the invention. The terms “right”, “left”, “up”, “down”, “under”

and "above" refer to directions in the figures. The terminology comprises the explicitly mentioned terms as well as their derivations and terms with a similar meaning. Also, spatially relative terms, such as "beneath", "below", "lower", "above", "upper", "proximal", "distal", and the like, may be used to describe one element's or feature's relationship to another element or feature as illustrated in the figures. These spatially relative terms are intended to encompass different positions and orientations of the devices in use or operation in addition to the position and orientation shown in the figures. For example, if a device in the figures is turned over, elements described as "below" or "beneath" other elements or features would then be "above" or "over" the other elements or features. Thus, the exemplary term "below" can encompass both positions and orientations of above and below. The devices may be otherwise oriented (rotated 90 degrees or at other orientations), and the spatially relative descriptors used herein interpreted accordingly. Likewise, descriptions of movement along and around various axes includes various special device positions and orientations.

To avoid repetition in the figures and the descriptions of the various aspects and illustrative embodiments, it should be understood that many features are common to many aspects and embodiments. Omission of an aspect from a description or figure does not imply that the aspect is missing from embodiments that incorporate that aspect. Instead, the aspect may have been omitted for clarity and to avoid prolix description. In this context, the following applies to the rest of this description: If, in order to clarify the drawings, a figure contains reference signs which are not explained in the directly associated part of the description, then it is referred to previous or following description sections. Further, for the reason of lucidity, if in a section of a drawing nor all features of a part are provided with reference signs it is referred to other sections of the same drawing. Like numbers in two or more figures represent the same or similar elements.

Figure 1:
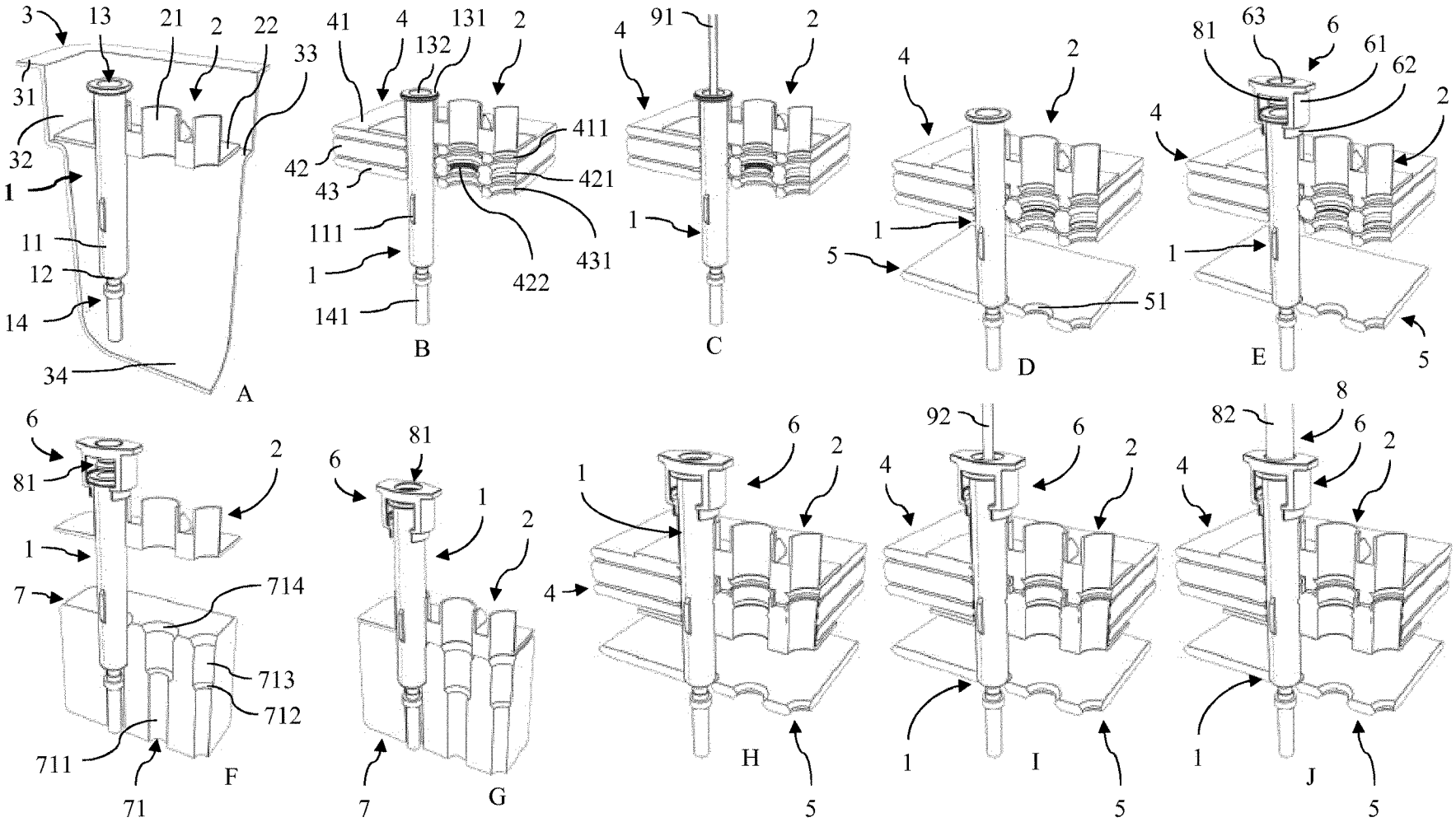
FIG. 1 shows perspective partial views of a first embodiment of a facility according to the invention implementing a first embodiment of a method according to the invention for preparing a syringe as a first embodiment of a double chamber container according to the invention.

FIG. 1 shows steps A to J of a first embodiment of a method according to the invention for preparing a staked-in needle double chamber syringe 1 as a double chamber container. The double chamber syringe 1 has a distal end side 12, a proximal end side 13 opposite to the distal end side 12 and a cylindrical body portion 11 with an interior between the distal end side 12 and the proximal end side 13. A distal opening provided with a needle 14 is arranged at the distal end side 12. The needle 14 is covered and protected by a rigid needle shield 141.

The proximal end side 13 of the syringe 1 has a proximal opening 132 surrounded by a finger flange 131. The distal end side 12, the body portion 11 and the proximal end side 13 with its finger flange 131 are integrally made of glass, i.e. are one piece. In a side wall of the body portion 11 a bulge is embodied as a bypass 111. The bulge has a polygonal longitudinal shape and is vertically arranged in the side wall.

In step A of the first method a set of identical syringes 1 is obtained in a tub 3. Each syringe 1 is arranged in a respective seat 21 of a holder 2. The holder 2 has a rectangular base plate 22 from which the seats 21 vertically and upwardly extend as hollow cylinders. The syringes 1 vertically extend through the seats 21 wherein the seats 21 are dimensioned such that needle 14, the distal end side 12 and the body portion 11 of the syringes 1 fit though the hollow cylinder but not the finger flange 131 of the proximal end side 13. Thus, the syringes 1 are arranged in the seats 21 of the holder 2 by hanging though the hollow cylinders wherein the finger flanges 131 lie on the top end of the hollow cylinders of the seats 21.

The tub 3 has a top border 31, a wider upper section 32 and a narrower lower section 34. Between the upper section 32 and the lower section 34 a shoulder section 33 is formed. When being arranged in the tub 3, the base plate 22 of the holder 2 lies on the shoulder section 33 of the tub 3. Thereby, the seats 21 and the portions of the syringes 1 being in the hollow cylinders lie in the upper section 32 of the tub 3 and the rest of the syringes 1 in the lower section 34 of the tub 3. For transporting the tub 3 together with the syringes 1, for example for delivering the syringes 1 to a suitable facility for preparing the syringes 1, the interior of the tub 3 can be sealed by a foil being bonded to the border 31 of the tub 3. Like this, the syringes 1 can be handled in a protected and sterile fashion.

In step B of the first method the holder 2 together with the syringes 1 are transferred by a transporter of a first facility for automatically performing the first method from the tub 3 to an alignment device 4 of the first facility. The transporter can be a robot such as a linear robot or an arm robot or the like. The alignment device 4 comprises a central main plate 42 with flat top and bottom surfaces, an upper alignment plate 41 on the top surface of the main plate 42 and a lower alignment plate 43 on the bottom surface of the main plate 42. The upper alignment plate 41 has a plurality of though bores 411 corresponding to the arrangement of the seats 21 of the holder 2, the main plate 42 has respective through bores 421 and the lower alignment plate 43 has respective through bores 431. The through bores 421 of the main plate 42 are further provided with a abating ring 422. Adjacent through bores 411, 421, 431 of the upper alignment plate 41, the main plate 42 and the lower alignment plate 43 together form adjustment openings of the alignment device 4.

For arranging the syringes 1 in the alignment device 4 the holder 2 is placed on a top surface of the upper alignment plate 41 such that each one of the seats 21 of the holder 2 is on top of an adjustment opening of the alignment device 4. Thereby, the syringes 1 extend through the adjustment openings of the alignment device 4. The main plate 42 is laterally movable such that the upper alignment plate 41 and the lower alignment plate 43 are shifted along the top surface of the main body 42 or along the bottom surface of the main body 42, respectively. Like this, the syringes 1 can be precisely aligned by moving the upper and lower alignment plates 41, 43 of the alignment device 4 such that, e.g., substances can be exactly delivered into the syringes 1 as described in the following.

In step C a substance such as a liquid pharmaceutical substance or particularly a liquid biopharmaceutical substance is fed into the interior of each syringe 1. For this purpose a discharge pipe of a substance dosing feeder 91 of the first facility is entered through the proximal opening 132 into the interior of the respective syringe 1. Then the substance is filled into the interior of the syringe 1 wherein the syringe 1 is precisely aligned by the alignment device 4 in order to allow for preventing leakage and contamination. The substance is thereby lying on the bottoms of the interiors of the syringes 1, i.e. at the distal end sides 12 of the syringes 1.

In step D the syringes 1 are positioned in a centering plate 5 of the first facility while still being arranged in the alignment device 4. The centering plate 5 has recesses 51 located in correspondence with the location of the seats 21 of the holder 2. Each recess 51 is embodied as a conical though hole such that the distal end sides 12 of the syringes 1 can be received and held. As shown in step E, when being pushed upwardly, held and stabilized by the centering plate 5, on each syringe 1 a cap 6 made of a plastic material is clipped. The caps 6 have a horizontal top head portion with a central though hole 63, a first lateral cylinder segment portion 61 adjacent to the head portion and a second lateral cylinder segment portion 62. The first lateral cylinder segment portion 61 is wider than the second lateral cylinder segment portion 62.

In particular, the second lateral cylinder segment portion 62 is dimensioned to clamp the body portion 11 of the respective syringe 1 from its outside and the first lateral cylinder segment portion 61 is dimensioned to pass the finger flange 131 of the syringes 1. Between the first lateral cylinder segment portion 61 and the second lateral cylinder segment portion 62 a step is formed which is adjacent to and contacts the finger flange 131 of the respective syringe 1. In the through holes 63 of the caps 6 middle plungers are arranged. Thereby, the through holes 63 of the caps 6 are dimensioned to slightly hold the middle plungers 81 by friction wherein the middle plungers 81 project below the through holes 63. Due to the height of the first lateral cylinder segment portions 61 of the caps 6 the middle plungers 81 are held distant from the proximal openings 132 of the syringes 1 when the finger flanges 131 contact the steps between the first lateral cylinder segment portions 61 and the second lateral cylinder segment portions 62.

In step F the holder 2 together with the syringes 1 is transferred by the transporter of the first facility to a freeze-drying block 7 of a freeze-dryer of the first facility. Thereby, during transfer the syringes 1 hang in the seats 21 of the holder 2 wherein the lower ends of the second lateral cylinder segment portions 62 of the caps 6 lie on top of the hollow cylinders of the seats 21.

The freeze-drying block 7 is made of aluminium and has receptacles 71 located in correspondence with the location of the seats 21 of the holder 2. Each receptacle 71 is embodied as a bore with a profile shaped to receive one of the syringes 1. In particular, the profiles of the receptacles 71 have a lower needle section 711 dimensioned to receive the needle 14 of one of the syringes 1 and an upper body section 713 dimensioned to contact the lower part of the body portion 11 of the syringe 1. Between the needle section 711 and the body section 713 a shoulder section 712 is formed which is dimensioned to receiving the distal end side 12 of the syringe 1. The top side of the body section 713 passes over into a conical entrance section 714 which allows for conveniently entering the respective syringe 1 into the receptacle 71.

When the syringes 1 are arranged in the receptacles 71 of the freeze-drying block 7 heat is provided via the side walls of the body portions 713 of the receptacles 71 and the side walls of the body portions 11 of the syringes 1 to the liquid substance being at the bottoms of the body portions 11 of the syringes 1. Like this, the heat is conductively transferred to the substance and simultaneously the section of the body portions 11 of the syringes 1 where the substance is located is shielded with respect to heat irradiation. By conductively providing the heat to the substance a homogeneous heat transfer and lyophilisation is achieved. Furthermore, the isolation allows for preventing the substance being heated by irradiation during freeze-drying but, e.g. mainly by conductive heat transfer. Since the middle plungers 81 are held by the caps 6 distant from the proximal openings 132 of the syringes 1 gas and steam escapes the syringes 1 during freeze-drying via the proximal openings 132.

In step G, after freeze-drying the substance is finished, the caps 6 are pressed down on the syringes 1 and the middle plungers 81 are closing the back openings 132 of the syringes 1. After closing the syringes 1 a vacuum in the interior of the syringes 1 is broken and the pressure difference moves the middle plungers 81 into the interior of the syringes 1. Thereby, the pressure difference defines the final position of the middle plungers 81 which is above the bypasses 111 of the syringes 1. Like this, two chambers are built in the interior of each syringe 1, i.e. one lower or distal chamber comprising the freeze-dried substance and one upper or proximal chamber. The middle plungers 81 seal the distal chambers from the proximal chambers.

In step H the holder 2 together with the syringes 1 is transferred again into the alignment device 4 and the centering plate 5. In step I a discharging pipe of a medium dosing feeder 92 of the first facility is entered through the proximal opening 132 into the interior of the respective syringe 1. The medium dosing feeder 92 feeds a reconstitution medium or diluent in the proximal chamber of the syringe 1 wherein the syringe 1 is precisely aligned by the alignment device 4. After being fed, the reconstitution medium lies on the top of the middle plungers 81 above the bypasses 111 of the body portions 11 of the syringes 1.

In step J the proximal openings 132 of the syringes 1 are sealed by pushing end plungers by means of a vent tube 82 of a plunger filling arrangement 8 of the first facility into top sections of the interiors of the body portions 11. Thereby, the syringes 1 still are arranged in the alignment device 4 and the centering plate 5. Eventual respective pushing forces can be received by the centering plate 5. After the proximal openings 132 of the syringes 1 being sealed, the holder 2 together with the syringes 1 is transferred by the transporter to the tub 3 they have initially been delivered to the facility. In the tub 3 the syringes 1 can be delivered or shipped for further processing such as optical inspection, secondary packaging or the like.

As shown hereinabove, the syringes 1 are arranged in the seats 21 of the holder 2 throughout the complete preparation. This allows for an efficient handling and processing.

Figure 2:
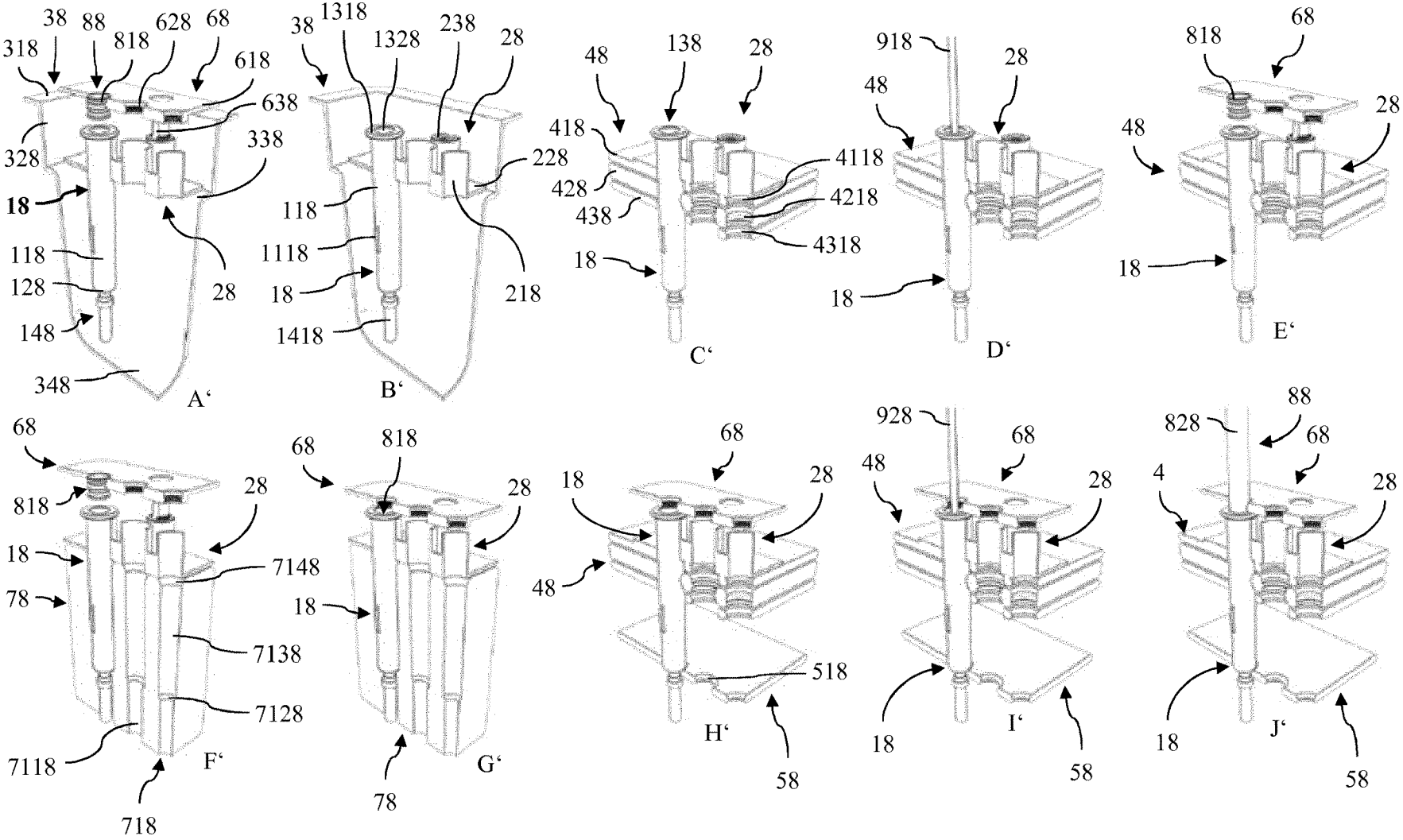
FIG. 2 shows perspective partial views of a second embodiment of a facility according to the invention implementing a second embodiment of a method according to the invention for preparing the syringe from FIG. 1.

FIG. 2 shows steps A' to J' of a second embodiment of a method according to the invention for preparing a staked-in needle double chamber syringe 18 as a double chamber container. Some components and their usage in the second embodiment of the method are identical to the components and usage described hereinbefore with regard to the first method. In particular, the syringes 18 having a needle 148 with a rigid needle shield 1418, a distal end side 128, a body portion 118 with a bypass 1118 and a proximal end side 138 with a proximal opening 1328 and a finger flange 1318 are identical to the syringes 1 described in connection with FIG. 1. Further, an alignment device 48 comprising a main plate 428 with through bores 4218, an upper alignment plate 418 with through bores 4118 and a lower alignment plate 438 with through bores 4318 is identical to the alignment device 4 described above in connection with FIG. 1. Still further, a tub 38 having a top border 318, a wider upper section 328, a shoulder section 338 and a narrower lower section 348, a centering plate 58 with recesses 518 and a freeze-drying block 78 comprising receptacles 718 each with a lower needle section 7118 an upper body section 7138, a shoulder section 7128 and a conical entrance section 7148 are identical to the tub 3, the centering plate 5 and the freeze-drying block 7 described above in connection with FIG. 1.

In step A' of the second method a set of identical syringes 18 is obtained in the tub 38. Each syringe 18 is arranged in a respective seat 218 of a holder 28. The holder 28 has a rectangular base plate 228 from which the seats 218 vertically and upwardly extend as hollow cylinders. The syringes 18 vertically extend through the seats 21 wherein the seats 218 are dimensioned such that the needles 148, the distal end sides 128 and the body portions 118 of the syringes 18 fit though the hollow cylinders but not the finger flanges 1318 of the proximal end sides 138. The holder 28 further has plural hollow snap-in cylinders 238 extending vertically and upwardly from the base plate 228 of the holder 28.

On top of the border 318 of the tub 38 a plunger tray 68 is positioned and delivered together with the tub 38. The plunger tray 68 has plural through holes 628 as seats each being provided with a middle plunger 818. The through holes 628 are located in a base plate 618 of the plunger tray 68 such that each of the middle plungers 818 is located adjacent to one of the proximal openings 1328 of the syringes 18. The plunger tray 68 is further equipped with distancing feet 638 as spacer at locations corresponding to the snap-in cylinders 238 of the holder 28.

In step B' the plunger tray 68 is removed from the tub 38 such that the holder 28 and the syringes 18 are accessible. The plunger tray 68 is put aside for being further processed in steps E' to J' of the second method. Corresponding to steps B and C of the first method described above, in steps C' and D' the holder 68 together with the syringes 18 is transferred by a transporter of a second embodiment of a facility implementing the second method to the alignment device 48 and filled with the substance by means of a substance dosing feeder 918.

In step E' the holder 28 and the syringes 18 still are arranged in the alignment device 48. The plunger tray 68 is placed on top of the holder 28 wherein the distancing feet 638 are placed on the snap-in cylinders 238. In this position the distancing feet 638 do not engage into the snap-in cylinders 238 but are lying on top of them only. Like this, the plunger tray 68 can be positioned such that each one of the middle plungers 818 is held adjacent and in a predefined distance from one of the proximal openings 1328 of the syringes 18.

In step F' the holder 28 together with the syringes 18, the plunger tray 68 and the middle plungers 818 are transferred to the freeze-drying block 78. There, the substance is freeze-dried inside the interior of the syringes 18 as described above with respect to step F of FIG. 1. Thereby, the plunger tray 68 and the middle plungers 818 are still held distant from the proximal openings 1328 of the syringes 18.

In step G' the plunger tray is pushed into the direction of the holder 28 and the syringes 18 being in the freeze-drying block 78. Thereby, the distance feet 638 of the plunger tray 68 snap into the snap-in cylinders 238 of the holder 28. The middle plungers 818 are moved together with the plunger tray 68 and partially inserted into the proximal openings 1328 of the syringes 18. After partially inserting the middle plungers 818 a vacuum in the interior of the syringes 18 is broken and the pressure difference moves the middle plungers 818 into the interior of the syringes 18. Thereby, the pressure difference defines the final position of the middle plungers 818 which is above the bypasses 1118 of the syringes 18. Like this, two chambers are built in the interior of each syringe 18, i.e. one lower or distal chamber comprising the freeze-dried substance and one upper or proximal chamber. The middle plungers 818 seal the distal chambers from the proximal chambers.

In step H' the holder 28 together with the syringes 1 is transferred again by the transporter of the second facility into the alignment device 48 and the centering plate 58. In step I' a medium dosing feeder 928 of the second facility is entered through the through holes 628 and the proximal opening 1328 into the interior of the respective syringe 18. The medium dosing feeder feeds a reconstitution medium or diluent in the proximal chamber of the syringes 18 wherein the syringes 18 are precisely aligned by the alignment device 48. After being fed, the reconstitution medium lies on the top of the middle plungers 818 which are above the bypasses 1118 of the body portions 118 of the syringes 18.

In step J' the proximal openings 1328 of the syringes 18 are sealed by pushing end plungers by means of a vent tube 828 of a plunger filling arrangement 88 of the second facility into top sections of the interiors of the body portions 118. Thereby, the syringes 18 still are arranged in the alignment device 48 and the centering plate 58. Eventual respective pushing forces can be received by the centering plate 58. After the proximal openings 1328 of the syringes 18 being sealed, the holder 28 together with the syringes 18 is transferred by the transporter to the tub 38 they have initially been delivered to the second facility. In the tub 38 the syringes 18 can be delivered or shipped for further processing such as optical inspection, secondary packaging or the like.

Figure 3:
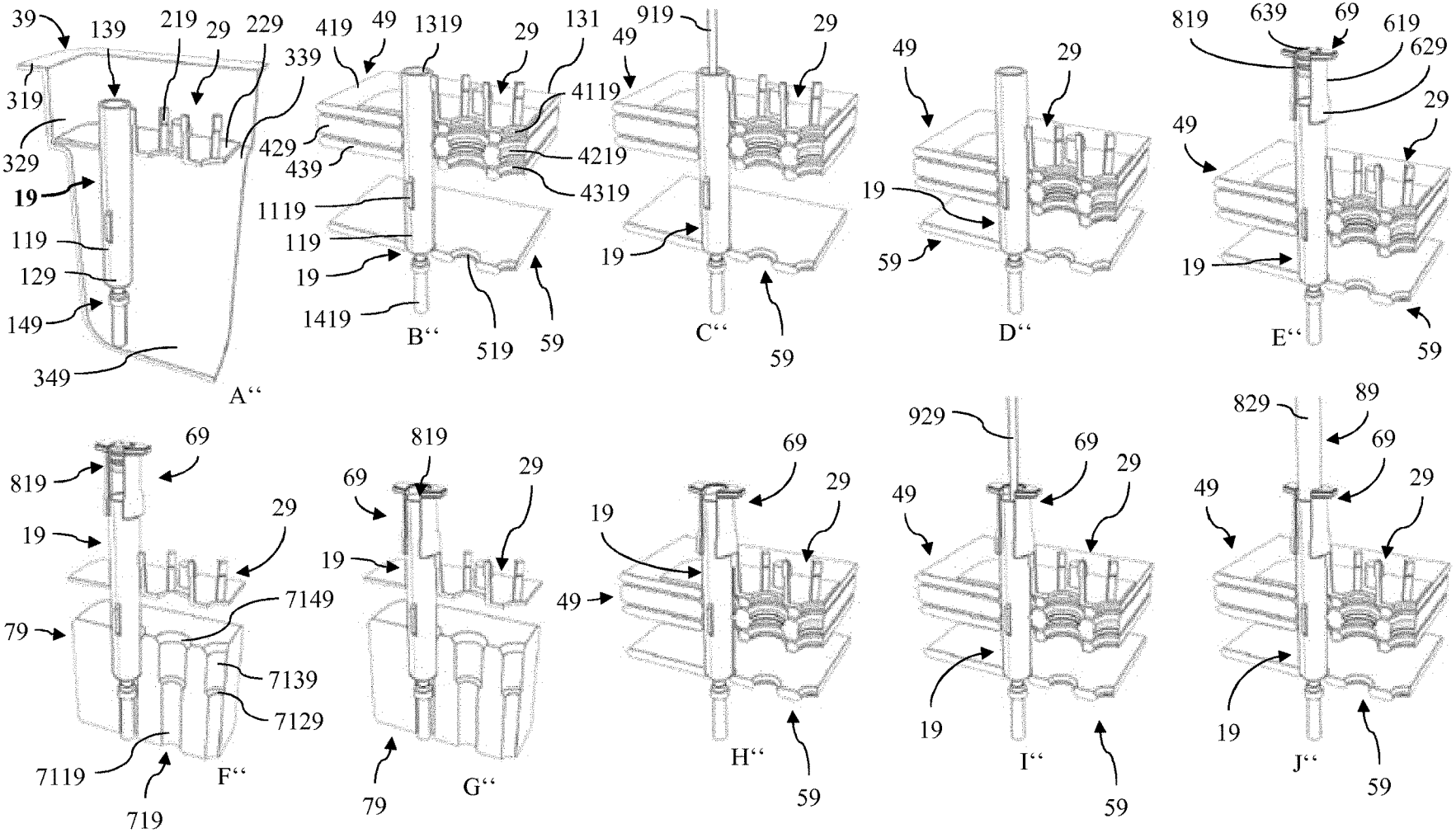
FIG. 3 shows perspective partial views of a third embodiment of a facility according to the invention implementing a third embodiment of a method according to the invention for preparing a syringe as a second embodiment of a double chamber container according to the invention.

FIG. 3 shows steps A" to J" of a third embodiment of a method according to the invention for preparing staked-in needle double chamber syringes 19 as double chamber containers implemented in a third embodiment of a facility. Some components and their usage in the third method are identical to the components and usage described hereinbefore with regard to the first method. In particular, an alignment device 49 comprising a main plate 429 with through bores 4219, an upper alignment plate 419 with through bores 4119 and a lower alignment plate 439 with through bores 4319 is identical to the alignment device 4 described above in connection with FIG. 1. Further, a tub 39 having a top border 319, a wider upper section 329, a shoulder section 339 and a narrower lower section 349, a centering plate 59 with recesses 519 and a freeze-drying block 79 comprising receptacles 719 with a lower needle section 7119, an upper body section 7139, a shoulder section 7129 and a conical entrance section 7149 are identical to the tub 3, the centering plate 5 and the freeze-drying block 7 described above in connection with FIG. 1.

The syringes 19 used in the third method are also similar to the syringes 1 used in the first method as described above. In particular, the syringes 19 of the third method have identical needles 149 with rigid needle shields 1419, a distal end side 129, a body portion 119 with a bypass 1119 and a proximal end side 139 with a proximal opening 1319. However, in contrast to the syringes 1 described above the syringes 19 of the third method do not have finger flanges integral with the glass body portions 119 of the syringes 19.

In step A" of the third method a set of identical syringes 19 is obtained in the tub 39. Each syringe 19 is arranged in a respective seat 219 of a holder 29. The holder 29 has a rectangular base plate 229 from which the seats 219 vertically and upwardly extend. Each seat 219 comprises essentially vertical and elastic clamping fingers around an opening in the base plate 229. The syringes 19 are held and clamped by the camping fingers of the according seats 219. The syringes 19 vertically extend through the seats 219.

In step B" the holder 29 together with the syringes 19 are transferred by a transporter of the third facility for implementing the third method into the alignment device 49 and the centering plate 59. In particular, the holder 29 is placed on a top surface of the upper alignment plate 419 such that each one of the seats 219 of the holder 29 is on top of an adjustment opening of the alignment device 49. Thereby, the syringes 19 extend through the adjustment openings of the alignment device 49. Further, the distal end sides 129 of the syringes 19 are arranged in the recesses 519 of the centering plate 59.

Corresponding to step C of the first method described above, in step C" the holder 69 together with the syringes 19 is filled with a substance by means of a substance dosing feeder 919. In step D", the holder 29 and the syringes 19 still are arranged in the alignment device 49 and the centering plate 59 wherein the distance between the centering plate 59 and the alignment device 49 is reduced. Like this, the syringes 19 are lifted to a predefined extent.

In step E", when being held and stabilized by the centering plate 59, on each syringe 19 a cap 69 made of a plastic material is arranged. The caps 69 have a horizontal top head portion with a central though hole 639, a first lateral cylinder segment portion 619 adjacent to the top head portion and a second lateral cylinder segment portion 629. The second lateral cylinder segment portion 629 is wider than the first lateral cylinder segment portion 619.

In particular, the second lateral cylinder segment portion 629 is dimensioned to loosely receive the body portion 119 of the syringes 19 and the first lateral cylinder segment portion 619 is dimensioned to clamp the body portion 119 of the syringes 19 from the outside. In step E" the caps 69 are placed on the syringes 19 by piling the first lateral cylinder segment portions 619 on the body portions 119 of the syringes 19 but not the second lateral cylinder segment portion 629. In the through holes 639 of the caps 69 middle plungers 819 are arranged. Thereby, the through holes 639 are dimensioned to slightly clamp the middle plungers 819. Due to the height of the first lateral cylinder segment portions 619 of the caps 69 the middle plungers are held distant from the proximal openings 1329 of the syringes 19.

In step F" the holder 29 together with the syringes 19, the caps 69 and the middle plungers 819 are transferred to the freeze-drying block 79 by the transporter of the third facility. There, the substance is freeze-dried inside the interior of the syringes 19 as described above with respect to step F of FIG. 1.

In step G" the caps 69 are pushed onto the syringes 19 being in the freeze-drying block 79. Thereby, the body portions 119 of syringes 19 are clamped in the first lateral cylinder segment portions 619 of the caps 69. The middle plungers 819 are moved together with the caps 69 and partially inserted into the proximal openings 1329 of the syringes 19. The horizontal top head portions of the caps 69 are now finger flanges of the syringes 19. After partially inserting the middle plungers 819 a vacuum in the interior of the syringes 19 is broken and the pressure difference moves the middle plungers 819 into the interior of the syringes 19. Thereby, the pressure difference defines the final position of the middle plungers 819 which is above the bypasses 1119 of the syringes 19. Like this, two chambers are built in the interior of each syringe 19, i.e. one lower or distal chamber comprising the freeze-dried substance and one upper or proximal chamber. The middle plungers 819 seal the distal chambers from the proximal chambers.

In step H" the holder 29 together with the syringes 19 is transferred again by the transporter of the third facility into the alignment device 49 and the centering plate 59. In step I" a medium dosing feeder 929 of the third facility is entered through the proximal opening 1329 into the interior of the respective syringe 19. The medium dosing feeder 929 feeds a reconstitution medium or diluent in the proximal chamber of the syringes 19 wherein the syringes 19 are precisely aligned by the alignment device 49. After being fed, the reconstitution medium lies on top of the middle plungers 819 which is above the bypass 1119 of the body portion 119 of the syringe 19.

In step J" the proximal openings 1329 of the syringes 19 are sealed by pushing end plungers by means of vent tubes 829 of a plunger filling arrangement 89 of the third facility into top sections of the interiors of the body portions 119. Thereby, the vent tubes 829 are partially inserted into the interior of the body portions 119. After the proximal openings 1329 of the syringes 19 being sealed, the holder 29 together with the syringes 19 is transferred to a tub identical to the tub 49 they have initially been delivered. In the tub the syringes 19 can be delivered or shipped for further processing such as optical inspection, secondary packaging or the like.

Figure 4:
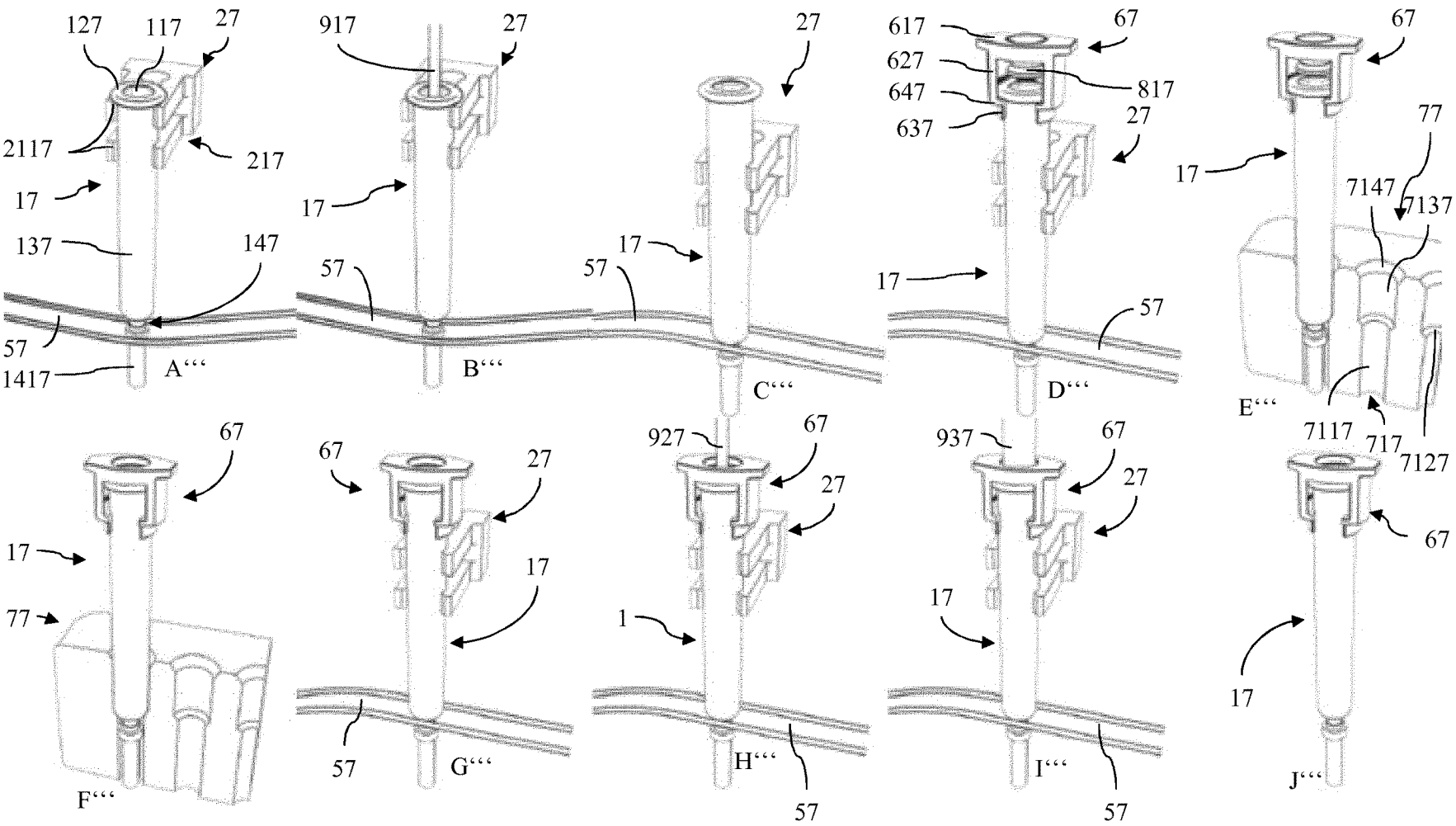
FIG. 4 shows perspective partial views of a fourth embodiment of a facility according to the invention implementing a fourth embodiment of a method according to the invention for preparing a syringe as a third embodiment of a double chamber container according to the invention.

FIG. 4 shows steps A''' to J''' of a fourth embodiment of a method according to the invention for preparing a staked-in needle double chamber syringe 17 as a double chamber container. The fourth method is implemented in a fourth embodiment of a facility for preparing the syringe 17.

The syringe 17 has a distal end side, a proximal end side opposite to the distal end side and a cylindrical body portion 137 with an interior between the distal end side and the proximal end side. A distal opening provided with a needle 147 is arranged at the distal end side of the syringe 17. The needle 147 is covered and protected by a rigid needle shield 1417.

The proximal end side of the syringe 17 has a proximal opening 117 for accessing the interior of the body portion 137 surrounded by a finger flange 127. The distal end side, the body portion 137 and the proximal end side with its finger flange 127 are integrally made of glass, i.e. are one piece.

In step A''' of the fourth method the syringe 17 is arranged in a respective seat 217 of a holder 27 of the fourth facility. The seat 217 of the holder 27 has two parallel supporting arms 2117 which receive the body portion 137 of the syringe 17 in a vertical alignment in which the proximal opening 117 is at a top end of the syringe 17 and the rigid needle shield 147 is at a bottom end of the syringe 17. The syringe 17 is abutting with its finger flange 127 onto the top end of the upper supporting arm 2117 of the seat 217 of the holder 27. Thereby, the syringe 17 is vertically hanging between the supporting arms 2117 of the holder 27.

Below the distal end side of the syringe 17 two parallel guiding rails 57 of the fourth facility are arranged. The rigid needle shield 147 of the syringe 17 extends downwardly through the guiding rails 57. The two guiding rails 57 have a distance from each other suitable for the rigid needle shield 147 to fit in between or to pass through but not for the body portion 137 of the syringe 17.

In step B''' of the fourth method the holder 27 together with the syringe 17 is transferred along the guiding rails 57 by a transporter of the fourth facility to a feeding station of the facility. There a substance such as a liquid pharmaceutical substance or particularly a liquid biopharmaceutical substance is fed into the interior of the syringe 17. For this purpose a discharge pipe of a substance dosing feeder 917 of the fourth facility is entered through the proximal opening 117 into the interior of the syringe 17. Then the substance is filled into the interior of the syringe 17 wherein the syringe 17 is aligned by the holder 27 and the guiding rails 57 in order to prevent leakage and contamination. After feeding, the substance is lying on the bottom of the interior of the syringe 17, i.e. at the distal end side of the syringe 17.

In step C''' the syringe 17 and the holder 27 are further travelled along the guiding rails 57 by the transporter of the fourth facility. The guiding rails 57 are raising such that the distance between the guiding rails 57 and the holder 27 decreases. Since the body portion 137 of the syringe 17 does not fit between the guiding rails 57 the distal end side of the body portion 137 abuts onto the guiding rails 57. Like this the syringe 17 is lifted such that the finger flange 127 is distant from the holder 27.

As shown in step D'", in this lifted position a cap 67 made of a plastic material is clipped on the syringe 17. The cap 67 comprises a plunger seat 617, a container connector 637 and a spacer 627 between the plunger seat 617 and the container connector 637. The plunger seat 617 is formed as a longitudinal plate of a constant thickness having plane top and bottom surfaces. In a top view the longitudinal plate widens towards its middle such that a central section of the plate has the largest width. In this central section of the longitudinal plate a central through-hole is arranged.

On its bottom surface the longitudinal plate passes over into the spacer 627. The spacer 627 comprises two opposing cylinder segments. The cylinder segments surround a circular cylindrical interior. Each of the two lateral sections of the longitudinal plate form a protrusion laterally projecting over the spacer 627. On their bottom ends each of the cylinder segments of the spacer 627 pass over into a cylinder segment of a clamping portion of the container connector 637 via a step 647. The cylinder segments of the clamping portion of the container connector 637 also surround a circular cylindrical interior. The two cylinder segments of the clamping portion of the container connector 637 have an inner diameter which is smaller than an inner diameter of cylinder segments of the spacer 627. Thus, the step 647 inwardly extends from the cylinder segments 6271 of the spacer 627 to the cylinder segments of the clamping portion of the container connector 637.

Inside the through-hole of the plunger seat 617 of the cap 67 a rubber middle plunger 817 is arranged. The through-hole is dimensioned to releasably clamp the middle plunger 817. Thereby, the middle plunger 817 projects below the through-hole downwardly to a certain extent.

The clamping portion of the container connector 637 and in particular its cylinder segments clamp the body portion 137 of the syringe 17 adjacent to its finger flange 127. The step 647 of the cap 67 contacts an edge of the finger flange 127 of the syringe 17. The inner diameter of the two cylinder segments of the clamping portion is slightly smaller than the outer diameter of the body portion 137 of the syringe 17. Thus, for the syringe 17 being arranged between the two cylinder segments, the clamping portion has to be elastically outwardly bent such that it is tensioned. Like this the body portion 137 is attached in between the cylinder segments of the container connector 637 of the cap 67.

The inner diameter of the cylinder segments of the spacer 627 of the cap 67 are dimensioned such that the finger flange 127 of the syringe 17 fits in between. I.e. the inner diameter of the cylinder segments of the spacer 627 is identical or slightly bigger than the outer diameter of the finger flange 127 of the syringe 17.

Due to the height of the spacer 627 of the cap 67, the middle plunger 817 is held distant from the proximal openings 117 of the syringe 17 when the finger flange 127 contacts the step 647. Thus, in this position the proximal opening 117 and the interior of the syringe 17 are open and accessible.

In step E'" the syringe 17 is transferred by the transporter of the fourth facility to a freeze-drying block 77 of a freeze-dryer of the fourth facility. The freeze-drying block 77 is made of aluminium and has plural receptacles 717. Each receptacle 717 is embodied as a bore with a profile shaped to receive one syringe 17. In particular, the profiles of the receptacles 717 have a lower needle section 7117 dimensioned to receive the needle 147 together with the rigid needle shell 1417 of the syringe 17 and an upper body section 7137 dimensioned to contact the lower part of the body portion 137 of the syringe 17. Between the needle section 7117 and the body section 7137 a shoulder section 7127 is formed which is dimensioned to receiving the distal end side of the syringe 17. The top side of the body section 7137 passes over into a conical entrance section 7147 which allows for conveniently entering the syringe 17 into the receptacle 717.

When the syringe 17 is arranged in one of the receptacles 717 of the freeze-drying block 77, heat is provided via the side walls of the body portions 7137 of the receptacles 717 and the side walls of the body portion 137 of the syringe 17 to the liquid substance being at the bottom of the body portions 137 of the syringe 17. Like this, the heat is conductively transferred to the substance and simultaneously the section of the body portion 137 of the syringe 17 where the substance is located is shielded with respect to heat irradiation. By conductively providing the heat to the substance a homogeneous heat transfer and lyophilisation is achieved. Furthermore, the shielding allows for preventing the substance being heated by irradiation during lyophilisation but, e.g., mainly by conductive heat transfer. Since the middle plunger 817 is held by the support of the device distant from the proximal opening 117 of the syringe 17 gas and steam escapes the syringe 17 via the proximal opening 117 during lyophilisation.

In step F'", after lyophilisation of the substance, the cap 67 is pushed down on the syringe 17 and the middle plunger 817 is inserted into the proximal opening 117 of the syringe 17. Since resulting from lyophilisation of the substance an underpressure is induced in the interior of the syringe 17 the middle plunger 817 is sucked into the syringe 17. Thereby, the middle plunger 817 is moved as far into the syringe 17 such that two chambers are formed inside the syringe 17 wherein the middle plunger 817 seals a distal chamber housing the lyophilised substance from a proximal chamber.

In step G'" the syringe 17 is again positioned in the holder 27 as described above wherein the rigid needle shield 147 extends through the guiding rails 57. As shown in step H'", the holder 27 together with the syringe 17 is then transferred along the guiding rails 57 by the transporter of the fourth facility to the feeding station of the fourth facility. There, a discharging pipe of a medium dosing feeder 927 of the fourth facility is entered through the though-hole of the plunger seat 617 of the cap 67 and the proximal opening 117 into the interior of the syringe 17. The medium dosing feeder 927 feeds a reconstitution medium or diluent in the proximal chamber of the syringe 17. After being fed, the reconstitution medium lies on top of the middle plunger 817 inside the syringe 17, i.e., in its proximal chamber.

In step I'" a end plunger is pressed into the proximal opening 117 of the syringe 17 by means of a vent tube 937. Thereby, the proximal opening 117 of the syringe 17 is sealed by the end plunger. The syringe 17 is arranged in the guiding rails 57 wherein the distal end side of the body portion 137 abuts the rails 57. Like this, eventual pushing forces induced on the syringe 17 by the vent tube 937 can be received by the guiding rails 57.

After the proximal opening 117 of the syringe 17 being sealed, the holder 27 together with the syringe 17 is transferred out of the fourth facility by the transporter. In step J'" the finally prepared syringe 17 being ready to be delivered or further processed is shown. As described hereinabove, the syringe 17 is arranged in an upright position throughout the complete preparation process. This allows for an efficient handling and processing.

While the invention has been illustrated and described in detail in the drawings and foregoing description, such illustration and description are to be considered illustrative or exemplary and not restrictive. It will be understood that changes and modifications may be made by those of ordinary skill within the scope and spirit of the following claims. In particular, the present invention covers further embodiments with any combination of features from different embodiments described above and below. Various mechanical, compositional, structural, electrical, and operational changes may be made without departing from the spirit and scope of this description and the claims. In some instances, well-known circuits, structures, and techniques have not been shown in detail in order not to obscure the invention. Like numbers in two or more figures represent the same or similar elements.

The invention also covers all further features shown in the Figs. individually although they may not have been described in the afore or following description. Also, single alternatives of the embodiments described in the figures and the description and single alternatives of features thereof can be disclaimed from the subject matter of the invention or from disclosed subject matter. The disclosure comprises subject matter consisting of the features defined in the claims ort the exemplary embodiments as well as subject matter comprising said features.

Furthermore, in the claims the word "comprising" does not exclude other elements or steps, and the indefinite article "a" or "an" does not exclude a plurality. A single unit or step may fulfil the functions of several features recited in the claims. The mere fact that certain measures are recited in mutually different dependent claims does not indicate that a combination of these measures cannot be used to advantage. The terms "essentially", "about", "approximately" and the like in connection with an attribute or a value particularly also define exactly the attribute or exactly the value, respectively. The term "about" in the context of a given numerate value or range refers to a value or range that is, e.g., within 20%, within 10%, within 5%, or within 2% of the given value or range. Any reference signs in the claims should not be construed as limiting the scope.

The invention claimed is:

1. A method of preparing a double chamber container having a distal end side, a proximal end side opposite to the distal end side, an interior between the distal end side and the proximal end side, a distal opening arranged in the distal end side for providing a medium out of the double chamber container and a proximal opening in the proximal end side, comprising:

filling a substance in the interior of the double chamber container;

freeze-drying the substance inside the double chamber container;

inserting a middle plunger in the interior of the double chamber container such that a distal chamber and a proximal chamber are formed, wherein the middle plunger seals the distal chamber from the proximal chamber and wherein the substance is inside the distal chamber after freeze-drying;

filling a reconstitution medium in the proximal chamber of the double chamber container;

sealing the proximal opening of the double chamber container;

providing a holder having a seat arranged to receive the double chamber container in an upright position; and arranging the double chamber container in the seat of the holder such that, in the upright position, the distal end side of the double chamber container extends downwardly and the proximal end side of the double chamber container extends upwardly, wherein the double chamber container is arranged in the upright position in the seat of the holder while the substance is filled in the interior of the double chamber container, while the substance is freeze-dried inside the double chamber container, while the middle plunger is pushed in the interior of the double chamber container, while the reconstitution medium is filled in the proximal chamber of the double chamber container, and while the proximal opening of the double chamber container is sealed.

2. The method according to claim 1, wherein the substance is filled in the interior of the double chamber container through the proximal opening of the double chamber container, gas is exiting the double chamber container through its proximal opening while the substance is freeze-dried inside the double chamber container, the middle plunger is inserted in the interior of the double chamber container through the proximal opening of the double chamber container and the reconstitution medium is filled in the proximal chamber of the double chamber container through the proximal opening of the double chamber container.

3. The method according to claim 1, wherein the double chamber container has a side wall connecting the distal end side and the proximal end side and wherein, while freeze-drying the substance inside the double chamber container, heat is conductively transferred through the side wall of the double chamber container.

4. The method according to claim 3, wherein the heat is conductively transferred through a section of the side wall of the double chamber container which is adjacent to the substance being arranged in the interior of the double chamber container.

5. The method according to claim 3, wherein, while freeze-drying the substance inside the double chamber container, a section of the double chamber container which is adjacent to the substance being arranged in the interior of the double chamber container is shielded with respect to heat irradiation.

6. The method according to claim 1, wherein the double chamber container is arranged in a receptacle of a freeze-drying block such that the receptacle of the freeze-drying block encases the distal end side of the double chamber container.

7. The method according to claim 1, wherein the holder is positioned on an alignment device having an adjustment opening such that the double chamber container extends through the adjustment opening of the alignment device while the substance is filled in the interior of the double chamber container.

8. The method according to claim 7, wherein the alignment device comprises two plates each having a through bore, wherein the through bores of the two plates form the adjustment opening of the alignment device and wherein the two plates are laterally movable in relation to each other.

9. The method according to claim 7, wherein the distal end side of the double chamber container is arranged in a recess of a centering plate when the double chamber container extends through the adjustment opening of the alignment device.

10. The method according to claim 1, wherein the holder has a plurality of seats comprising the seat and at least one identical additional seat, wherein a plurality of double chamber containers comprising the double chamber container and at least one identical additional double chamber container is arranged in the plurality of seats of the holder, the method comprising:

filling the substance in each of the plurality of double chamber containers while arranged in the plurality of seats of the holder;

freeze-drying the substance inside the plurality of double chamber containers while arranged in the plurality of seats of the holder;

inserting one of a plurality of middle plungers comprising the middle plunger and at least one additional middle plunger in the interior of each of the plurality of double chamber containers while arranged in the plurality of seats of the holder;

filling the reconstitution medium in the proximal chamber of each of the plurality of double chamber containers while arranged in the plurality of seats of the holder; and sealing the proximal opening of each of the plurality of double chamber containers while arranged in the plurality of seats of the holder.

11. The method according to claim 6, wherein the freeze-drying block has a plurality of receptacles comprising the receptacle and at least one identical additional receptacle, wherein a plurality of double chamber containers comprising the double chamber container and at least one identical additional double chamber container are each is arranged in one of the plurality of receptacles of the freeze-drying block when freeze-drying the substance inside the plurality of double chamber containers.

12. The method according to claim 7, wherein the alignment device has a plurality of adjustment openings comprising the adjustment opening and at least one identical additional adjustment opening, wherein a plurality of double chamber containers comprising the double chamber container and at least one identical additional double chamber container each extend through one of the plurality of adjustment openings of the alignment device while the substance is filled in the interiors of the plurality of double chamber containers.

13. The method according to claim 10, wherein the plurality of middle plungers are arranged together in respective seats of a plunger tray having a spacer;

the plunger tray is arranged with its spacer on the holder such that the middle plunger and the at least one additional middle plunger are adjacent to the proximal openings of the double chamber container and the at least one identical additional double chamber container; and the middle plunger and the at least one additional middle plunger are inserted through the proximal openings of the plurality of double chamber containers after freeze-drying the substance inside the plurality of double chamber containers.

14. A double chamber container having a non-planar distal end side, a proximal end side opposite to the distal end side, an interior between the distal end side and the proximal end side, a distal opening arranged in the distal end side for providing a medium out of the double chamber container and a proximal opening in the proximal end side, wherein the double chamber container is prepared by a method comprising:

filling a substance in the interior of the double chamber container;

freeze-drying the substance inside the double chamber container;

inserting a middle plunger in the interior of the double chamber container such that a distal chamber and a proximal chamber are formed, wherein the middle plunger seals the distal chamber from the proximal chamber and wherein the substance is inside the distal chamber after freeze-drying;

filling a reconstitution medium in the proximal chamber of the double chamber container;

sealing the proximal opening of the double chamber container;

providing a holder having a seat arranged to receive the double chamber container in an upright position; and arranging the double chamber container in the seat of the holder such that, in the upright position, the distal end side of the double chamber container extends downwardly and the proximal end side of the double chamber container extends upwardly, wherein the double chamber container is arranged in the upright position in the seat of the holder while the substance is filled in the interior of the double chamber container, while the substance is freeze-dried inside the double chamber container, while the middle plunger is pushed in the interior of the double chamber container, while the reconstitution medium is filled in the proximal chamber of the double chamber container, and while the proximal opening of the double chamber container is sealed.

15. The double chamber container according to claim 14, wherein the substance inside the distal chamber of the interior of the double chamber container after freeze-drying has a shape with a front side adjacent to and corresponding to the non-planar distal end side of the double chamber container.

* * * * *